US005792032A

United States Patent [19]

Williams et al.

[11] Patent Number: 5,792,032

[45] Date of Patent: Aug. 11, 1998

[54] TRAINING MANNIKIN

[75] Inventors: Jon A. Williams; Cassie M. Evans, both of Longview, Tex.

[73] Assignee: Medical Plastics Laboratory, Inc., Gatesville, Tex.

[21] Appl. No.: 775,865

[22] Filed: Jan. 2, 1997

[51] Int. Cl.[6] ..... A63B 69/34

[52] U.S. Cl. ..... 482/83; 482/87; 482/90

[58] Field of Search ..... 446/268; 482/83–90; 269/87.2

[56] References Cited

U.S. PATENT DOCUMENTS

| | | | |
|---|---|---|---|
| 1,557,636 | 10/1925 | Warner | 446/268 |
| 1,890,695 | 12/1932 | Rosenhahn | 482/90 |
| 5,281,191 | 1/1994 | DeSousa | 482/83 |
| 5,554,088 | 9/1996 | Zlojotro | 482/83 |

FOREIGN PATENT DOCUMENTS

| | | | |
|---|---|---|---|
| 0286512 | 1/1991 | Germany | 482/83 |

*Primary Examiner*—Jerome Donnelly
*Attorney, Agent, or Firm*—Locke Purnell Rain Harrell

[57] ABSTRACT

A training system is formed by supporting a mannikin torso on a rigidly fixed base. The mannikin torso provides anatomically defined aiming references and may be attached to a frame which is supported by the base. The base allows the frame to be positioned either in a vertical or angled forward position to provide differing types of training. A harness is provided which is adapted to support the mannikin torso when it is detached from the frame and base. The harness has arm straps to allow a coach or trainer to move the mannikin torso to simulate more realistic sparring.

11 Claims, 4 Drawing Sheets

TRAINING MANNIKIN

This invention relates to sparring and self-defense training. More particularly, the invention relates to sparring and training systems employing a mannikin which is adjustably supported on a fixed base to present the mannikin in different spatial orientations.

BACKGROUND OF THE INVENTION

Traditionally, punching bags are formed from an outer shell filled with padding. The bags are usually geometrically shaped (for example, cylindrical, spherical or rectangular) and suspended with chains or the like from an overhead support. The bag is sometimes carried or strapped to a trainer's hands or forearms. The standard cylindrical punching bag, while a useful training tool, does not provide anatomical reference points or lifelike feedback when punched or kicked. Further, in sparring situations an opponent's shoulders are almost never square to the combatant. A right-handed opponent will be turned at an angle with his left shoulder closer to the combatant than his right. Opponents can also either be right-handed or left-handed. Left-handed opponents provide a much different target than do right-handed opponents, primarily due to the different stance which turns the opponent's shoulders opposite direction than those of the right-handed opponent. Traditional bags cannot simulate stance differences based on predominant hand. This limits their usefulness as training tools.

Additionally, different techniques are required for "fighting inside" than are used for normal sparring. "Fighting inside" can loosely be defined as encounters where the opponents are very close to one another or well within the reach of each other. When fighting inside, combatants usually assume a much more defensive posture which involves bending at the waist to give the opponent a smaller target to hit. Prior training bags are unable to simulate this technique and are inadequate for training a fighter to fight inside.

SUMMARY OF THE INVENTION

In accordance with the present invention, a training system is provided which allows the person being trained to practice punching and kicking techniques under a variety of different situations. The present invention employs a substantially life-size mannikin torso in place of the standard punching bag or pad. The mannikin torso includes a head, shoulders, chest and midsection to provide anatomically defined aiming references for self-defense and fighting training.

The training system permits various methods of using the mannikin torso. First, the mannikin can be removeably mounted to a frame which is inserted into a base which firmly holds the frame in place and anchors the training system to the ground, floor, etc. The base includes at least two apertures sized to receive the frame. The first aperture holds the frame and training mannikin torso in a substantially vertical position which is useful for teaching standard sparring techniques. The second aperture angles the frame and mannikin torso forward to simulate an "inside fighting" posture. This position allows the mannikin torso to be used to teach close fighting techniques.

The frame of the self-defense training system can be adjusted to alter the relative height of the mannikin torso to simulate opponents of various heights. Adjustability in the frame may be accomplished by two telescoping members whose relative positions are maintained by a pin or other securing mechanism. The frame may also include a spring connecting two portions of the frame which allows the mannikin torso to respond when struck and provide a more realistic feel to training. Further, the frame and mannikin torso may rotated to one side or the other to simulate the fighting stance of a left-handed or a right-handed opponent.

In addition to the base and frame support, the mannikin may also be used with a harness which holds the mannikin torso. The harness is fitted with a strap which is attached to a coach or training partner. The coach can then move with the mannikin providing a moving target without subjecting the coach or partner to being struck by the person being trained.

Other features and advantages of the invention will become more readily understood from the following detailed description taken in conjunction with the appended claims and attached drawing wherein:

DESCRIPTION OF THE PREFERRED EMBODIMENTS

Figure 1:
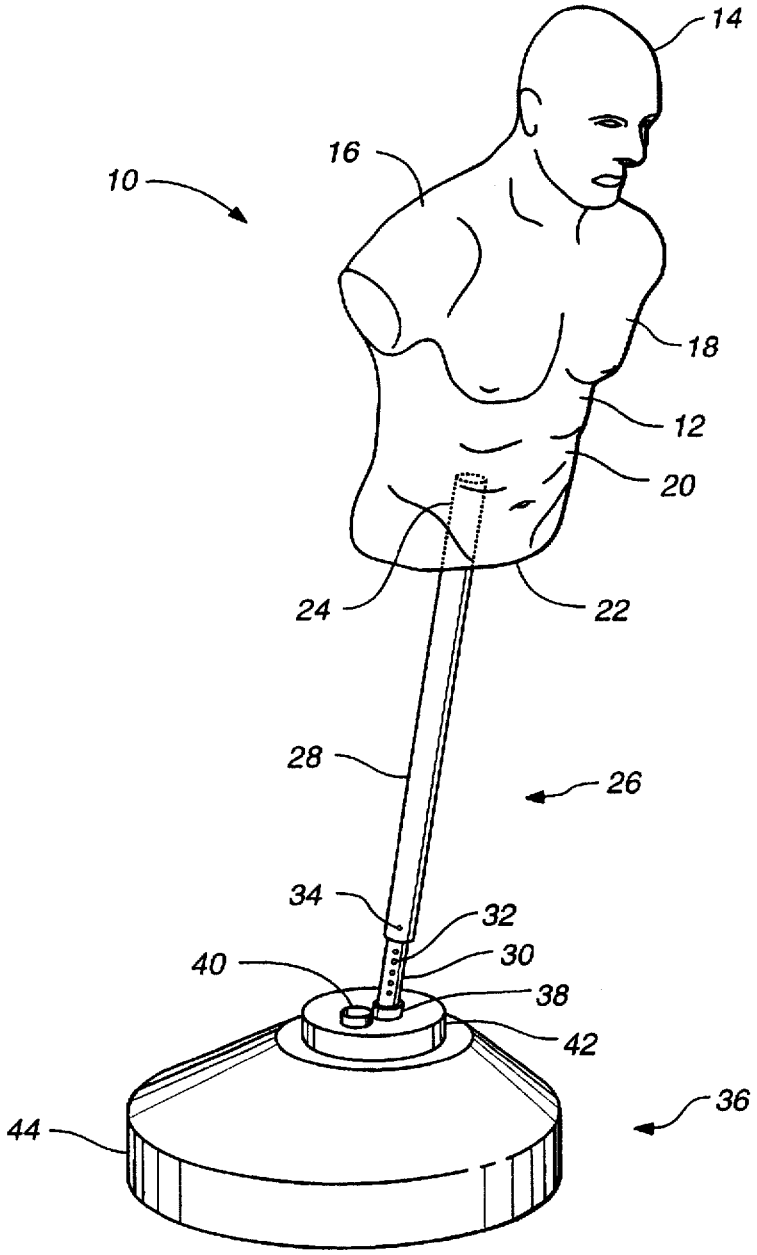
FIG. 1 is a perspective view of a preferred embodiment a training system of the invention using a mannikin torso attached to a frame mounted in a base in the angled forward position.

In FIG. 1 a preferred embodiment of the training system 10 is shown in its stand-alone implementation. This embodiment uses base 36 and frame 26 to hold mannikin torso 12 in a fixed position on a base without overhead or other additional support. Mannikin torso 12 may be used as the training element in self-defense training system 10 instead of the standard punching bag or pad. Mannikin torso 12 incorporates human features including head 14, shoulders 16, chest 18 and midsection 20 to provide anatomical reference points which can be used by the person being trained. These anatomical reference points provide for much more realistic training than do standard punching bags.

Mannikin torso 12 may be formed from any number of materials which provide a life-like look and feel when hit. In the preferred embodiment, mannikin torso 12 is formed from a polyvinyl chloride material which not only provides good absorption of blows and life-like feel, but is also very durable and able to withstand repeated use.

In the stand-alone implementation of self-defense training system 10, frame cavity 24 on underside 22 of mannikin torso 12 is used to secure frame 26 to mannikin torso 12. Frame 26 is used to hold mannikin torso 12 substantially above base 36. In the preferred embodiment, frame 36 is formed of telescoping pieces 28 and 30. Telescoping piece 30 has outer dimensions which correspond to the inner dimensions of telescoping piece 30 such that telescoping piece 28 slides over telescoping piece 30, allowing the height of frame 26 to be adjusted while still ensuring that frame 26 is rigid. Height adjustment holes 32 are provided in telescoping piece 30 and used in conjunction with pin element 34 to fix frame 26 at the desired height. The adjustable height of frame 26 allows self-defense training system 10 to simulate persons of varying height for training purposes. Ideally, frame 26 is adjustable to the extent that persons ranging in height from as little as five feet to as tall a six feet six inches or more can be simulated.

Frame 26 is secured in place by base 36 which is discussed in greater detail with reference to FIG. 5. Base 36 includes weighted foundation 44 and anchoring portion 42 which hold anchoring mechanisms 38 and 40. In the preferred embodiment, anchoring mechanisms 38 and 44 are apertures into which frame 26 is inserted. Anchoring mechanism 38, into which frame 26 is inserted in FIG. 1, is an aperture formed at an angle such that when frame 26 is inserted, mannikin torso is angled forward to simulate an "inside fighting" posture. "Inside fighting" refers to the type of sparring which occurs when the combatants are very close. In such circumstances the combatants are usually in a tucked defensive position which angles the torso forward. Sparring techniques for "inside fighting" can be very different from normal sparring and are difficult to teach with standard punching bags. Self-defense training system 10 allows for teaching "inside fighting" techniques by providing a position for mannikin torso 12 to be angled forward, thereby simulating an "inside fighting" posture.

Figure 2:
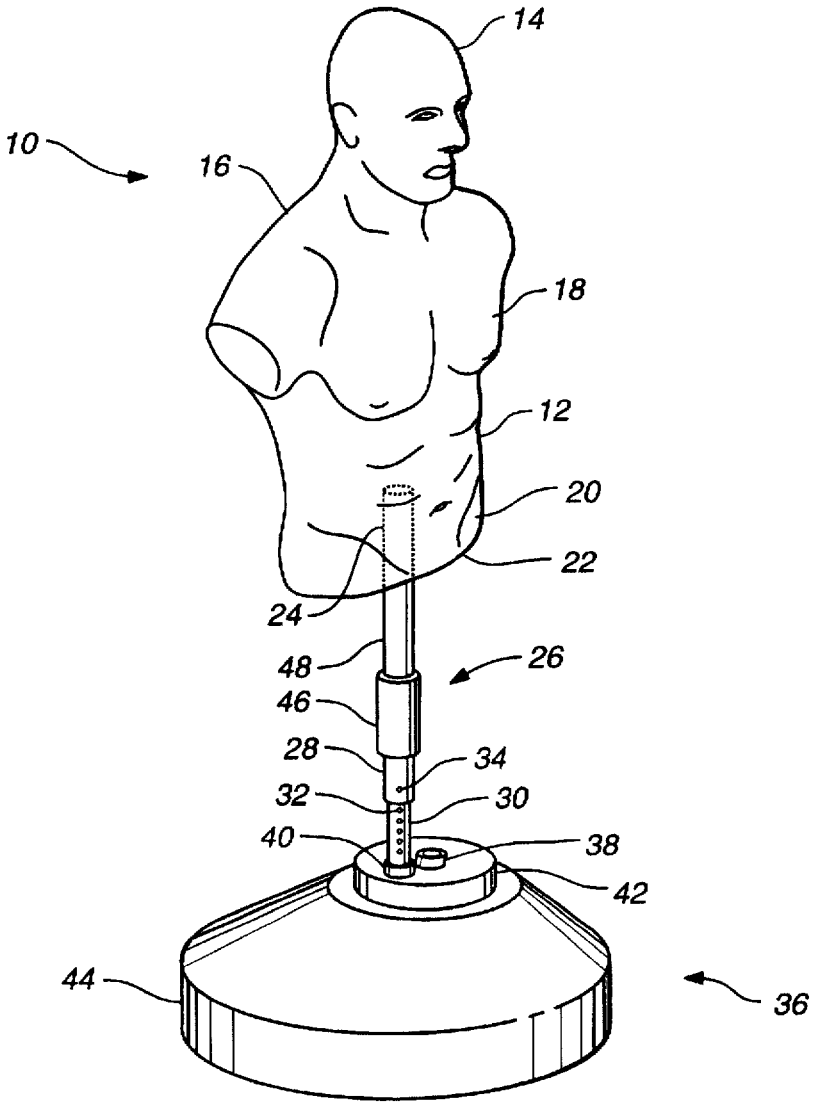
FIG. 2 is a perspective view of a training system using a mannikin torso attached to a frame mounted in a base in the vertical position.

In FIG. 2 training system 10 is shown again in stand-alone implementation. Mannikin torso 12 is again supported on frame 26 which is held substantially upright by base 36. In FIG. 2 mannikin torso 12 is positioned in the vertical position (as opposed to angled forward as shown in FIG. 1) by placing frame 26 in anchoring mechanism 40 instead of anchoring mechanism 38. The vertical position shown in FIG. 2 is the standard position for mannikin torso 12 to teach standard sparring techniques. To increase the effectiveness of self-defense training system 10, mannikin torso 12 may be rotated into alternate spatial orientations, as opposed to remaining permanently square to the combatant. Rotating mannikin torso 12 around the axis of frame 26 allows mannikin torso 12 to simulate either right-handed or left-handed opponents. In most sparring stances, an opponent will have his predominant hand further away from a combatant, resulting in his shoulders being at an angle to his combatant. This orientation cannot be simulated using standard punching bags.

FIG. 2 shows also an alternate embodiment of frame 26. Frame 26 in FIG. 2 incorporates spring 46 which allows mannikin torso 12 to respond to blows. To incorporate spring 46, frame member 48 is added which is inserted into frame cavity 24. Spring 46 connects frame member 46 to telescoping piece 28 which is used in conjunction with telescoping piece 30 as described above. Spring 46 can either be a metal coiled spring or can be formed from an appropriate elastic material. Spring 46 provides a more realistic feeling response when mannikin torso 12 is struck.

Figure 4:
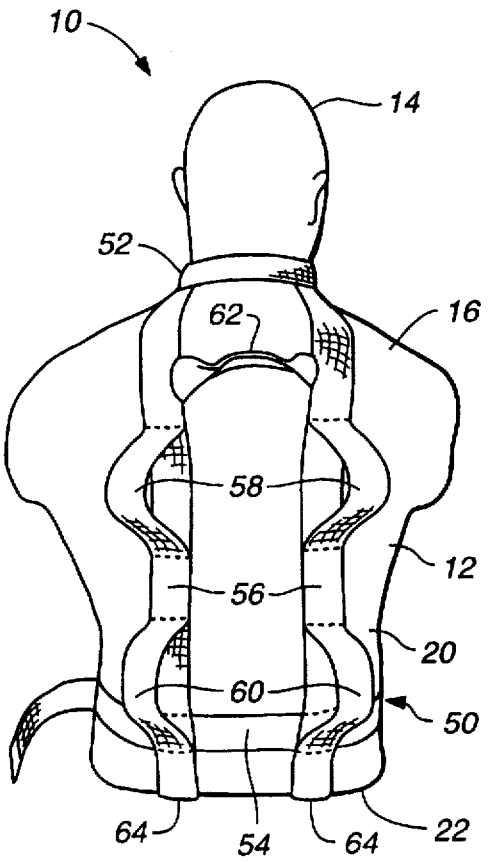
FIG. 4 is a back view of the training system shown in FIG. 3.
Figure 3:
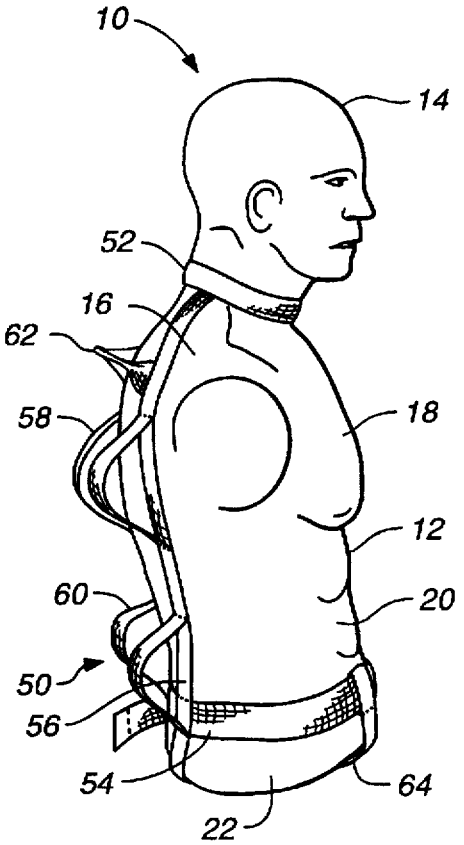
FIG. 3 is a side view of a training system using a harness and arm straps.

A mobile implementation of training system 10 is shown in FIGS. 3 and 4. In the mobile implementation, mannikin torso 12 is supported by harness 50 which is strapped to a coach or trainer instead of the frame and base as shown in FIGS. 1 and 2. Harness 50 is adapted to hold mannikin torso 12 with neck strap 52, waist strap 54 and lower straps 64. Neck strap 52 fastens around mannikin torso 12 between head 14 and shoulders 16. Waist strap 54 extends around midsection 20 of mannikin torso 12 and is connected to neck strap 52 by back straps 56. Back strap 56 extends past waist strap 54 under lower surface 22 of mannikin torso 12 and back up to waist strap 54 where it attaches, thereby forming lower straps 64.

Harness 50 is provided with multiple handstraps to allow it to be manipulated by the coach or trainer. Upper arm straps 58 and lower armstraps 60 are adapted to hold to the forearm of a coach or trainer. An arm is inserted through either upper arm straps 58 or lower arm straps 60 and then handle strap 62 is grasped with the opposite hand for support. Both upper arm straps 58 and lower arm straps 60 as well as handle strap 62 are secured to back straps 56.

The mobile implementation of training system 10 utilizing harness 50 allows a coach or trainer to provide a moving target for the student without subjecting themselves to being struck. With mannikin torso 12 in harness 50, the coach can simulate an opponent ducking, lunging, side-stepping or the like. This provides realistic sparring practice while maintaining the advantages (such as anatomical aiming references) of using mannikin torso 12.

Figure 5:
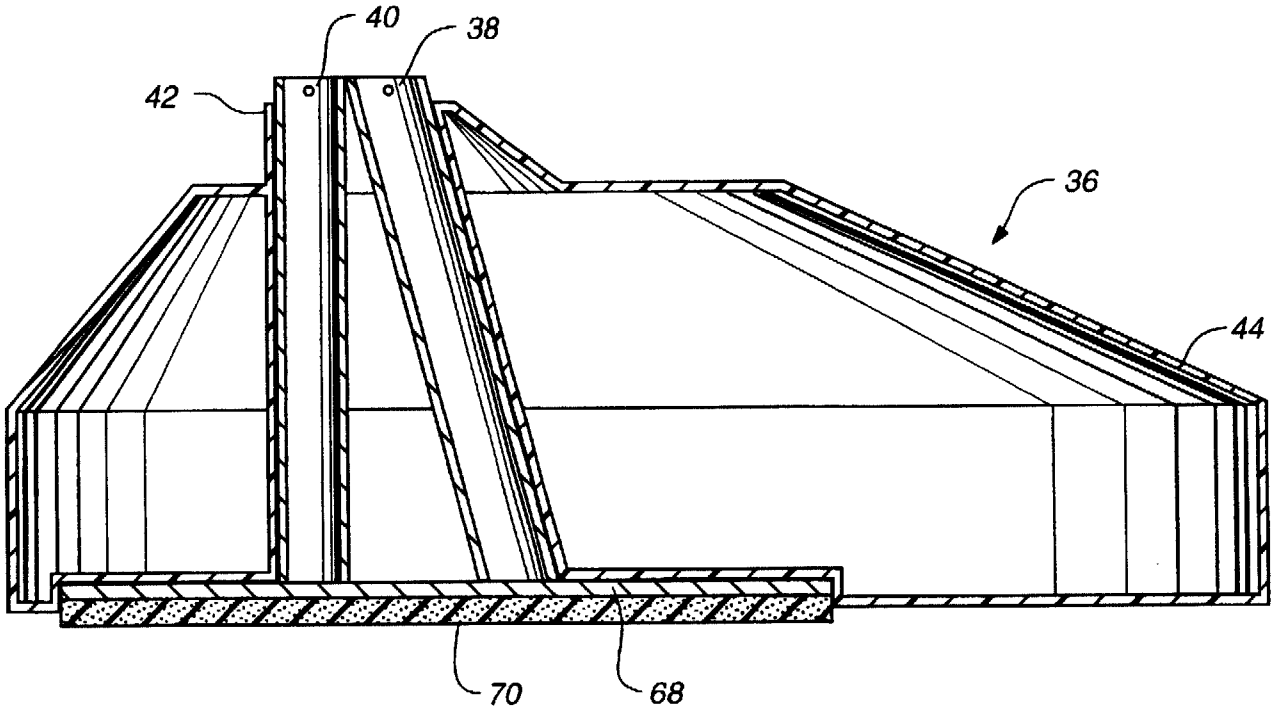
FIG. 5 is a sectional view of the base shown in FIG. 1. Like numerals are used to refer to like parts throughout the several views of the drawing.

FIG. 5 shows base 36 of FIGS. 1 and 2 in greater detail. Base 36 is substantially formed by weighted foundation 44. In the preferred embodiment, weighted foundation 44 is a polyethylene casing filled with a weighting material such as sand. Weighted foundation 44 also includes anchoring portion 42 which holds anchoring mechanisms 38 and 40. In the preferred embodiment anchoring mechanisms 38 and 40 are formed by steel pipes which are welded to base plate 68. Anchoring mechanisms 38 and 40 form apertures adapted to receive frame 26 illustrated in FIGS. 1 and 2. Anchoring mechanism 38 is angled slightly toward the front of base 36 to allow mannikin torso 12 to be placed in the angled forward position. Anchoring mechanism 40 is substantially vertical, allowing mannikin torso 12 to be anchored in the vertical position shown in FIG. 2. Foam pad 70 is secured to the bottom surface of base 36 to provide the necessary friction between base 36 and the ground or floor to prevent base 36 from slipping.

It is to be understood that although the invention has been described with particular reference to specific embodiments thereof, the forms of the invention shown and described in detail are to be taken as preferred embodiments of same. Various changes and modifications may be resorted to without departing from the spirit and scope of the invention as defined by the appended claims.

What is claimed:

1. A training system comprising:

a) a training mannikin in the shape of a human torso;

b) a frame having first and second ends, the first end connected to the training mannikin; and c) a base removably connected to the frame, the base having a first and second apertures sized to receive the second end of the frame, the first aperture aligned to place the training mannikin in a substantially vertical position when the frame is inserted therein and the second aperture angled to place the training mannikin in an angled forward position when the frame is inserted therein.

2. A training system as defined in claim 1 wherein the frame is comprised of two poles connected by a spring which allows the mannikin torso to give in response to being struck.

3. A training system as defined in claim 1 further comprising a harness connected to an arm strap and wherein the mannikin is removably attached to the frame, the harness adapted to receive the mannikin torso when detached from the frame, the arm strap allowing the mannikin torso when in the harness to be attached to a sparring partner for advanced training.

4. A training system as defined in claim 1 wherein the mannikin torso is formed from a poly-vinyl-chloride material.

5. A training system as defined in claim 1 wherein the frame is adjustable in length allowing the mannikin torso to simulate opponents of varying height.

6. The training system defined in claim 1 wherein the mannikin torso is rotatable around a substantially vertical axis defined by the frame such that the mannikin torso can be positioned to simulate both right-handed and left-handed opponents.

7. A training system as defined in claim 1 wherein the mannikin torso has a bottom surface and wherein the frame is removably connected to the mannikin torso by inserting the frame into an aperture on the bottom surface of the training mannikin.

8. The training system defined in claim 5 wherein the frame is formed by telescoping tubular members.

9. A training system comprising:

a) a training mannikin in the shape of a human torso which includes a head, shoulders, a chest and a midsection, the midsection having a bottom surface;

b) a frame having first and second ends, the first end removeably inserted into an aperture on the bottom surface of the training mannikin, the frame formed by telescoping tubular members which are positioned to simulate various opponent heights;

c) a base removeably connected to the frame, the base having a first and second apertures sized to receive the second end of the frame, the first aperture aligned to place the training mannikin in a substantially vertical position when the frame is inserted therein and the second aperture aligned to place the training mannikin in an angled forward position; and d) a harness adapted to receive the training mannikin when the training mannikin is detached from the frame, the harness including a strap which affixes to a coach to allow the coach to move the training mannikin for sparring purposes.

10. A training system as defined in claim 9 wherein one of the first or second tubular members of the frame is comprised of a first and second rod member, the first and second rod members connected by a spring which allows the training mannikin to react to blows.

11. A training system as defined in claim 10 wherein the mannikin torso is rotatable around its vertical axis such that the mannikin torso can be positioned to simulate both right-handed and left-handed opponents.

* * * * *